US011254892B2

(12) United States Patent
Watanabe

(10) Patent No.: US 11,254,892 B2
(45) Date of Patent: Feb. 22, 2022

(54) GREASE COMPOSITION

(71) Applicant: IDEMITSU KOSAN CO., LTD., Chiyoda-ku (JP)

(72) Inventor: Go Watanabe, Chiba (JP)

(73) Assignee: IDEMITSU KOSAN CO., LTD., Chiyoda-ku (JP)

( * ) Notice: Subject to any disclaimer, the term of this patent is extended or adjusted under 35 U.S.C. 154(b) by 0 days.

(21) Appl. No.: 16/632,925

(22) PCT Filed: Jan. 30, 2019

(86) PCT No.: PCT/JP2019/003193
§ 371 (c)(1),
(2) Date: Jan. 22, 2020

(87) PCT Pub. No.: WO2019/151332
PCT Pub. Date: Aug. 8, 2019

(65) Prior Publication Data

US 2020/0148970 A1 May 14, 2020

(30) Foreign Application Priority Data

Jan. 31, 2018 (JP) ..... JP2018-015575

(51) Int. Cl.
*C10M 169/02* (2006.01)
*C10M 101/00* (2006.01)
(Continued)

(52) U.S. Cl.
CPC ..... *C10M 169/02* (2013.01); *C10M 101/00* (2013.01); *C10M 115/08* (2013.01);
(Continued)

(58) Field of Classification Search
CPC ..... C10M 169/02; C10M 101/00; C10M 115/08; C10M 133/06; C10M 133/16;
(Continued)

(56) References Cited

U.S. PATENT DOCUMENTS 3,034,907 A * 5/1962 Kleemann ..... C10M 133/02 106/14.31
4,111,822 A * 9/1978 Caruso ..... C10M 5/00 508/552
(Continued)

FOREIGN PATENT DOCUMENTS

EP 1847586 10/2007
EP 3255130 12/2017
(Continued)

OTHER PUBLICATIONS

International Search Report dated Apr. 9, 2019 in PCT/JP2019/003193 filed on Jan. 30, 2019, 2 pages.
(Continued)

*Primary Examiner* — Cephia D Toomer
(74) *Attorney, Agent, or Firm* — Oblon, McClelland, Maier & Neustadt, L.L.P.

(57) ABSTRACT

The present invention relates to a grease composition containing a base oil (A), a thickener (B), and an additive (C) composed of at least two selected from a sarcosine derivative (C1), an amine compound (C2), and an amide compound (C3), wherein the content of the component (C) is 0.1 to 10.0% by mass on a basis of the total amount of the grease composition.

8 Claims, 3 Drawing Sheets

(51) Int. Cl.

| | |
|---|---|
| ***C10M 115/08*** | (2006.01) |
| ***C10M 133/06*** | (2006.01) |
| ***C10M 133/16*** | (2006.01) |
| ***C10M 169/04*** | (2006.01) |
| *C10N 20/06* | (2006.01) |

(52) U.S. Cl.
CPC ..... *C10M 133/06* (2013.01); *C10M 133/16* (2013.01); *C10M 169/042* (2013.01); *C10M 2205/0285* (2013.01); *C10M 2215/04* (2013.01); *C10M 2215/082* (2013.01); *C10M 2215/1026* (2013.01); *C10N 2020/06* (2013.01)

(58) Field of Classification Search
CPC ..... C10M 169/042; C10M 2205/0285; C10M 2215/04; C10M 2215/082; C10M 2215/1026; C10M 2020/06
See application file for complete search history.

(56) References Cited

U.S. PATENT DOCUMENTS

| | | | |
|---|---|---|---|
| 5,599,779 | A | 2/1997 | Karol et al. |
| 2006/0264338 | A1 | 11/2006 | Kawamura et al. |
| 2009/0003742 | A1 | 1/2009 | Nakatani et al. |
| 2015/0024980 | A1 | 1/2015 | Arai et al. |
| 2017/0002243 | A1 | 1/2017 | Porter et al. |

FOREIGN PATENT DOCUMENTS

| | | | |
|---|---|---|---|
| JP | 2008-115318 | A | 5/2008 |
| JP | 2010-106256 | A | 5/2010 |
| JP | 2013-181154 | A | 9/2013 |
| JP | 2015-147867 | A | 8/2015 |
| JP | 2015-147868 | A | 8/2015 |
| JP | 2017-502155 | A | 1/2017 |
| WO | WO 2006/078035 | A1 | 7/2006 |
| WO | WO 2017/126703 | A1 | 7/2017 |

OTHER PUBLICATIONS

Extended European Search Report dated Sep. 24, 2021, in EPC Application No. 19747161.8, 7 pages.

* cited by examiner

GREASE COMPOSITION

TECHNICAL FIELD

The present invention relates to a grease composition.

BACKGROUND ART

Grease is widely used for lubrication of a variety of sliding portions of automobiles and various industrial machines from the reasons that it is easy to achieve sealing as compared with lubricating oils, and downsizing or weight reduction of a machine to be applied can be achieved, and other reasons.

In recent years, from the viewpoint of weight reduction, processability, and so on, use of a resin material as a member of the sliding portion is being investigated.

For example, in a worm gear, the worm is made of a metal material from the viewpoint of strength. On the other hand, in order to prevent the generation of an unpleasant noise, such as a gear rattling noise and a vibration noise owing to contact with the worm, in many cases, a worm wheel is recently made of a resin material.

As for the lubrication of a sliding portion constituted of such metal material and resin material, there is a case where grease for using between metals cannot sufficiently exhibit characteristics, such as a friction-reducing effect and wear resistance. For that reason, there is demanded grease capable of adapting to lubrication of a sliding portion constituted of a metal material and a resin material.

For example, PTL 1 discloses a grease composition for resin lubrication for improving lubricity between a resin and a resin, and between a resin and other material, such as a metal, the composition containing a grease base material containing a base oil, a thickener and a specified unsaturated fatty acid amine salt.

CITATION LIST

Patent Literature

PTL 1: JP 2010-106256 A

SUMMARY OF INVENTION

Technical Problem

In lubrication of the sliding portion constituted of a metal material and a resin material, the grease composition described in PTL 1 is still insufficient from the standpoint of wear resistance to the resin material.

For example, in the sliding portion constituted of the metal material and the resin material in an apparatus which is used in the automobile field, from the viewpoint of suppressing stick-slip, there is demanded a grease composition which can decrease a friction coefficient, and improve the wear resistance of the resin material.

An object of the present invention is to provide a grease composition which has a low friction coefficient, is excellent in wear resistance, and can be suitably used for lubrication of a sliding portion which is, for example, constituted of a metal material and a resin material.

Solution to Problem

The present inventors have found that a grease composition containing at least two additives selected from a sarcosine derivative, an amine compound, and an amide compound together with a base oil and a thickener is able to solve the aforementioned problem, thereby leading to accomplishment of the present invention.

Specifically, the present invention relates to the following [1].

[1] A grease composition containing a base oil (A), a thickener (B), and an additive (C) composed of at least two selected from a sarcosine derivative (C1), an amine compound (C2), and an amide compound (C3), wherein the content of the component (C) is from 0.1 to 10.0% by mass on a basis of the total amount of the grease composition.

Advantageous Effects of Invention

The grease composition of the present invention has a low friction coefficient, is excellent in wear resistance, and can be suitably used for lubrication of a sliding portion which is, for example, constituted of a metal material and a resin material.

DESCRIPTION OF EMBODIMENTS

Figure 1:
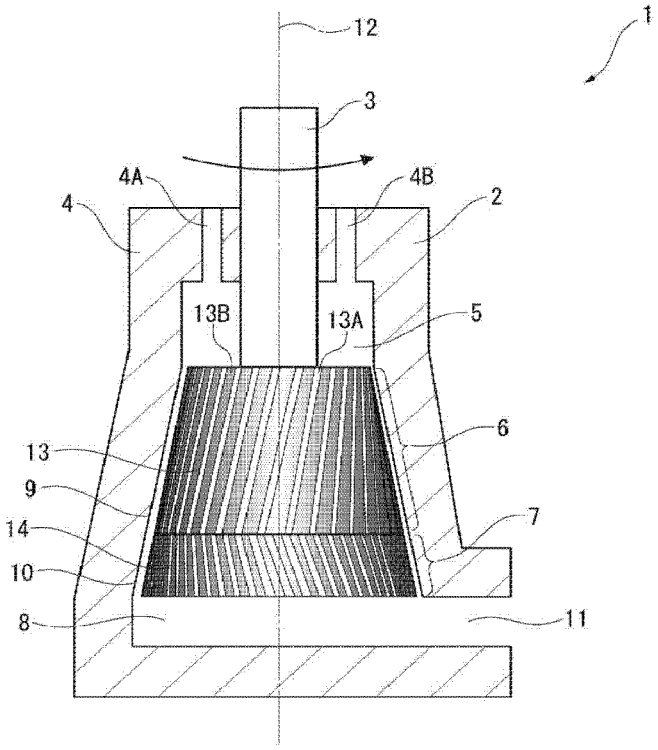
FIG. 1 is a schematic cross-sectional view of a grease manufacturing apparatus which can be used in one embodiment of the present invention.

The grease composition of the present invention contains a base oil (A), a thickener (B), and an additive (C) composed of at least two selected from a sarcosine derivative (C1), an amine compound (C2), and an amide compound (C3). In the following description, the base oil (A), the thickener (B), and the additive (C) are also referred to as a component (A), a component (B), and a component (C), respectively. In addition, in the following description, the sarcosine derivative (C1), the amine compound (C2), and the amide compound (C3) are also referred to as a component (C1), a component (C2), and a component (C3), respectively.

The grease composition of the present invention contains the component (C), and therefore, it has a low friction coefficient and is excellent in wear resistance.

In particular, in the case where the grease composition of the present invention is used for lubrication of a sliding portion constituted of a metal material and a resin material, it reveals excellent wear resistance to the resin material.

However, the grease composition of the present invention is naturally suitably useful for lubrication of not only the sliding portion constituted of a metal material and a resin material but also a sliding portion constituted of other materials.

The grease composition of one embodiment of the present invention may contain other additive for grease than the component (C) within a range where the effects of the present invention are not impaired.

However, in the grease composition of one embodiment of the present invention, the total content of the aforementioned components (A), (B), and (C) is preferably 65 to 100% by mass, more preferably 70 to 100% by mass, still more preferably 80 to 100% by mass, and yet still more preferably 90 to 100% by mass on a basis of the total amount (100% by mass) of the grease composition.

The grease composition of one embodiment of the present invention may be one prepared by blending the additive (C) composed of at least two selected from the sarcosine derivative (C1), the amine compound (C2), and the amide compound (C3) with the grease base material containing the base oil (A) and the thickener (B).

Here, the other additive for grease than the component (C) may be contained in the grease base material or may be one to be blended together with the component (C) with the grease base material.

<Base Oil (A)>

The base boil (A) which is contained in the grease composition of the present invention may be at least one selected from a mineral oil and a synthetic oil.

Examples of the mineral oil include a distillate obtained by subjecting a paraffinic crude oil, an intermediate base crude oil, or a naphthenic crude oil to atmospheric distillation and/or vacuum distillation; and a refined oil obtained by refining the foregoing distillate according to an ordinary method.

Examples of the purification method for obtaining a refined oil include a hydroreforming treatment, a solvent extraction treatment, a solvent dewaxing treatment, a hydroisomerization dewaxing treatment, a hydrorefining treatment, and a clay treatment.

GTL (gas-to-liquid) obtained by isomerizing a wax produced from a natural gas by the Fischer-Tropsch process, or the like may also be used as the mineral oil.

Examples of the synthetic oil include a hydrocarbon-based oil, an aromatic oil, an ester-based oil, and an ether-based oil.

Examples of the hydrocarbon-based oil include a poly-α-olefin (PAO), such as normal paraffin, isoparaffin, polybutene, polyisobutylene, a 1-decene oligomer, and a cooligomer of 1-decene and ethylene; and a hydrogenated product thereof.

Examples of the aromatic oil include an alkylbenzene, such as a monoalkylbenzene and a dialkylbenzene; and an alkylnaphthalene, such as a monoalkylnaphthalene, a dialkylnaphthalene, and a polyalkylnaphthalene.

Examples of the ester-base oil include a diester-based oil, such as dibutyl sebacate, di-2-ethylhexyl sebacate, dioctyl adipate, diisodecyl adipate, ditridecyl adipate, ditridecyl glutarate, and methyl acetyl ricinolate; an aromatic ester-based oil, such as trioctyl trimellitate, tridecyl trimellitate, and tetraoctyl pyromellitate; a polyol ester-based oil, such as trimethylolpropane caprylate, trimethylolpropane pelargonate, pentaerythritol-2-ethylhexanoate, and pentaerythritol pelargonate; and a complex ester-based oil, such as an oligoester of a polyhydric alcohol with a mixed fatty acid of a dibasic acid and a monobasic acid.

Examples of the ether-based oil include a polyglycol, such as polyethylene glycol, polypropylene glycol, polyethylene glycol monoether, and polypropylene glycol monoether; and a phenyl ether-based oil, such as a monoalkyl triphenyl ether, an alkyl diphenyl ether, a dialkyl diphenyl ether, pentaphenyl ether, tetraphenyl ether, a monoalkyl tetraphenyl ether, and a dialkyl tetraphenyl ether.

A kinematic viscosity at 40° C. of the base oil (A) which is used in one embodiment of the present invention is preferably 10 to 130 $mm^2/s$, more preferably 15 to 110 $mm^2/s$, and still more preferably 20 to 100 $mm^2/s$.

As the base oil (A) which is used in one embodiment of the present invention, a mixed base oil prepared by combining a high-viscosity base oil and a low-viscosity base oil to control the kinematic viscosity to the aforementioned range may be used.

A viscosity index of the base oil (A) which is used in one embodiment of the present invention is preferably 60 or more, more preferably 70 or more, and still more preferably 80 or more.

In this specification, the kinematic viscosity and the viscosity index each mean a value measured or calculated in conformity with JIS K2283:2003.

In the grease composition of one embodiment of the present invention, the content of the base oil (A) is preferably 50% by mass or more, more preferably 60% by mass or more, still more preferably 65% by mass or more, and yet still more preferably 70% by mass or more, and it is preferably 98.9% by mass or less, more preferably 97% by mass or less, still more preferably 95% by mass or less, and yet still more preferably 93% by mass or less, on a basis of the total amount (100% by mass) of the grease composition.

<Thickener (B)>

The thickener (B) which is contained in the grease composition of the present invention may be a metallic soap-based thickener or may be a urea-based thickener.

The thickener (B) which is used in one embodiment of the present invention may be used alone or may be used in combination of two or more thereof.

(Metallic Soap-Based Thickener)

The metallic soap-based thickener may be a metallic soap composed of a metal salt of a monovalent fatty acid or may be a metallic complex soap composed of a metal salt of a monovalent fatty acid and a metal salt of a divalent fatty acid.

Examples of the metallic soap include a lithium soap, a calcium soap, a sodium soap, barium soap, and an aluminum soap.

Examples of the metallic complex soap include a lithium complex soap, a calcium complex soap, a barium complex soap, and an aluminum complex soap.

Examples of the monovalent fatty acid constituting each of the metallic soap and the metallic complex soap include lauric acid, tridecylic acid, myristic acid, pentadecylic acid, palmitic acid, margaric acid, stearic acid, nonadecylic acid, arachidic acid, behenic acid, lignoceric acid, tallow acid, 9-hydroxystearic acid, 10-hydroxystearic acid, 12-hydroxystearic acid, 9,10-hydroxystearic acid, ricinoleic acid, and ricinoelaidic acid. Of these, a monovalent saturated fatty acid having 12 to 24 carbon atoms (preferably 12 to 18 carbon atoms, and more preferably 14 to 18 carbon atoms) is preferred.

Examples of the divalent fatty acid constituting the metallic complex soap include succinic acid, malonic acid, glutaric acid, adipic acid, pimelic acid, suberic acid, azelaic acid, and sebacic acid.

(Urea-Based Thickener)

As the urea-based thickener, any compound may be used so long as it has a urea bond. However, a diurea having two urea bonds is preferred, and a compound represented by the following general formula (b1) is more preferred.

$$R^1—NHCONH—R^3—NHCONH—R^2 \quad (b1)$$

The urea-based thickener which is used in one embodiment of the present invention may be used alone or may be used in admixture of two or more thereof.

In the general formula (b1), $R^1$ and $R^2$ each independently represent a monovalent hydrocarbon group having 6 to 24 carbon atoms, and $R^1$ and $R^2$ may be the same as or different from each other; and $R^3$ represents a divalent aromatic hydrocarbon group having 6 to 18 carbon atoms.

Although the carbon number of the monovalent hydrocarbon group which can be selected as $R^1$ and $R^2$ in the general formula (b1) is 6 to 24, it is preferably 6 to 20, and more preferably 6 to 18.

Examples of the monovalent hydrocarbon group which can be selected as $R^1$ and $R^2$ include a saturated or unsaturated monovalent chain hydrocarbon group, a saturated or unsaturated monovalent alicyclic hydrocarbon group, and a monovalent aromatic hydrocarbon group. Of these, a saturated or unsaturated monovalent chain hydrocarbon group or a saturated or unsaturated monovalent alicyclic hydrocarbon group is preferred.

Here, in $R^1$ and $R^2$ in the general formula (b1), when the content of the chain hydrocarbon group is designated as an X molar equivalent, the content of the alicyclic hydrocarbon group is designated as a Y molar equivalent, and the content of the aromatic hydrocarbon group is designated as a Z molar equivalent, it is preferred that the following requirements (a) and (b) are satisfied.

Requirement (a):

A value of $\{[X+Y)/(X+Y+Z)]\times 100\}$ is 90 or more (preferably 95 or more, more preferably 98 or more, and still more preferably 100).

Requirement (b):

An X/Y ratio is 50/50 to 0/100 (preferably 10/90 to 90/10, and more preferably 40/60 to 80/20).

In view of the fact that the aforementioned alicyclic hydrocarbon group, the aforementioned chain hydrocarbon group, and the aforementioned aromatic hydrocarbon are each a group to be selected as $R^1$ and $R^2$ in the general formula (b1), the sum total of the X, Y, and Z values is 2 molar equivalents per mol of the compound represented by the general formula (b1). In addition, the values of the requirements (a) and (b) each mean an average value of the total amount of the group of the compounds represented by the general formula (b1), which are contained in the grease composition.

By using the compound represented by the general formula (b1), which is satisfied with the requirements (a) and (b), a grease composition in which oil separation properties are more suppressed, and intervention properties of oil are improved can be provided.

The X, Y, and Z values can be calculated from a molar equivalent of each amine to be used as a raw material.

As the monovalent saturated chain hydrocarbon group, there is exemplified a linear or branched alkyl group having 6 to 24 carbon atoms. Specifically, examples thereof include a hexyl group, a heptyl group, an octyl group, a nonyl group, a decyl group, an undecyl group, a dodecyl group, a tridecyl group, a tetradecyl group, a pentadecyl group, a hexadecyl group, a heptadecyl group, an octadecyl group, an octadecenyl group, a nonadecyl group, and an eicosyl group.

As the monovalent unsaturated chain hydrocarbon group, there is exemplified a linear or branched alkenyl group having 6 to 24 carbon atoms. Specifically, examples thereof include a hexenyl group, a heptenyl group, an octenyl group, a nonenyl group, a decenyl group, a dodecenyl group, a tridecenyl group, a tetradecenyl group, a pentadecenyl group, a hexadecenyl group, an octadecenyl group, a nonadecenyl group, an eicosenyl group, an oleyl group, a geranyl group, a farnesyl group, and a linoleyl group.

The monovalent saturated chain hydrocarbon group and the monovalent unsaturated chain hydrocarbon group each may be a linear chain or a branched chain.

Examples of the monovalent saturated alicyclic hydrocarbon group include a cycloalkyl group, such as a cyclohexyl group, a cycloheptyl group, a cyclooctyl group, and a cyclononyl group; and a cycloalkyl group substituted with an alkyl group having 1 to 6 carbon atoms (preferably a cyclohexyl group substituted with an alkyl group having 1 to 6 carbon atoms), such as a methylcyclohexyl group, a dimethylcyclohexyl group, an ethylcyclohexyl group, a diethylcyclohexyl group, a propylcyclohexyl group, an isopropylcyclohexyl group, a 1-methyl-propylcyclohexyl group, a butylcyclohexyl group, a pentylcyclohexyl group, a pentyl-methylcyclohexyl group, and a hexylcyclohexyl group.

Examples of the monovalent unsaturated alicyclic hydrocarbon group include a cycloalkenyl group, such as a cyclohexenyl group, a cycloheptenyl group, and a cyclooctenyl group; and a cycloalkenyl group substituted with an alkyl group having 1 to 6 carbon atoms (preferably a cyclohexenyl group substituted with an alkyl group having 1 to 6 carbon atoms), such as a methylcyclohexenyl group, a dimethylcyclohexenyl group, an ethylcyclohexenyl group, a diethylcyclohexenyl group, and a propylcyclohexenyl group.

Examples of the monovalent aromatic hydrocarbon group include a phenyl group, a biphenyl group, a terphenyl group, a naphthyl group, a diphenylmethyl group, a diphenylethyl group, a diphenylpropyl group, a methylphenyl group, a dimethylphenyl group, an ethylphenyl group, and a propylphenyl group.

Although the carbon number of the divalent aromatic hydrocarbon group which can be selected as $R^3$ in the general formula (b1) is 6 to 18, it is preferably 6 to 15, and more preferably 6 to 13.

Examples of the divalent aromatic hydrocarbon group which can be selected as $R^3$ include a phenylene group, a diphenylmethylene group, a diphenylethylene group, a diphenylpropylene group, a methylphenylene group, a dimethylphenylene group, and an ethylphenylene group.

Of these, a phenylene group, a diphenylmethylene group, a diphenylethylene group, or a diphenylpropylene group is preferred, and a diphenylmethylene group is more preferred.

Now, in the grease composition of one embodiment of the present invention, in the case where the thickener (B) is a urea-based thickener, in a particle size distribution curve of particles containing the urea-based thickener on a volume basis according to the light scattering particle size measurement, it is preferred that a peak at which the frequency becomes maximum is satisfied with the following requirements (I) and (II).

Requirement (I):

A particle size at the peak at which the frequency becomes maximum is 1.0 μm or less.

Requirement (II):

A half width of the peak is 1.0 μm or less.

In this specification, the values prescribed by the requirements (I) and (II) are each a value which is calculated from the particle size distribution curve measured by the method in the section of Examples as mentioned later.

Although the "particles containing the urea-based thickener" to be measured herein refer to particles resulting from aggregation of the urea-based thickener, particles obtained by incorporating additive (C) and the other additive for grease into the urea-based thickener by aggregation of the urea-based thickener, additive (C) and the other additive for grease are also included.

On the other hand, an aggregate not containing the urea-based thickener but composed of only the additive (C)

and the other additive for grease is excluded from the aforementioned "particles containing the urea-based thickener". Here, it is meant by the word "excluded" that since the aggregate composed of only the additive (C) and the other additive for grease is very small in the content as compared with the "particles containing the urea-based thickener", the aggregate is not substantially detected according to the light scattering particle size measurement, and even if it would be detected, the content thereof is in a negligible level.

It may be said that the requirements (I) and (II) are a parameter expressing a state of aggregation of the urea-based thickener in the grease composition prepared by blending the additive (C) and the other additive for grease with the base oil (A), together with the urea-based thickener.

There is a case where in a synthesis process of the urea-based thickener, the urea-based thickener aggregates to form micelle particles (so-called "lumps"). It has been noted that the presence of micelle particles becomes a factor of lowering the wear resistance or friction characteristics of the resulting grease composition.

In the requirement (I), it is prescribed that the particle size at the peak at which the frequency becomes maximum is 1.0 μm or less. It may be said that the foregoing particle size is an index expressing a degree of aggregation of the urea-based thickener.

When the particle size is 1.0 μm or less, the aggregation of the urea-based thickener is appropriately suppressed, and a grease composition with favorable wear resistance or friction characteristics can be provided.

From the aforementioned viewpoint, though the particle size at the peak at which the frequency becomes maximum, as prescribed in the requirement (I), is 1.0 μm or less, it is preferably 0.9 μm or less, more preferably 0.8 μm or less, still more preferably 0.7 μm or less, and yet still more preferably 0.6 μm or less, and it is typically 0.01 μm or more.

The particle size at the peak at which the frequency becomes maximum means a value of the particle size at an apex of the peak.

Meanwhile, in the requirement (II), it is prescribed that the half width of the peak is 1.0 μm or less. It may be said that the foregoing half width is an index expressing the distribution state of particles containing the urea-based thickener larger than the particle size at the peak at which the frequency becomes maximum, as prescribed in the requirement (I).

Here, the half width of the peak as prescribed in the requirement (II) expresses a spreading width of the particle size at 50% of the maximum frequency of the requirement (I) in the particle size distribution curve on a volume basis according to the light scattering particle size measurement of the particles.

Namely, when the foregoing half width is 1.0 μm or less, it may be said that an existing proportion of micelle particles of the urea-based thickener having a particle size excessively larger than the particle size as prescribed in the requirement (I) is suppressed to a low level. As a result, a lowering of the wear resistance or friction characteristics to be caused due to the presence of giant micelle particles can be effectively suppressed.

From the aforementioned viewpoint, though the half width of the peak as prescribed in the requirement (II) is 1.0 μm or less, it is preferably 0.9 μm or less, more preferably 0.8 μm or less, still more preferably 0.7 μm or less, and yet still more preferably 0.6 μm or less, and it is typically 0.01 μm or more.

The values prescribed in the requirements (I) and (II) are relatively largely affected by a production condition of the urea-based thickener or a blending condition of the additive for grease, such as the component (C).

One examples of a specific measure for undergoing the preparation so as to have the values prescribed in the requirements (I) and (II) is one described in the section of "Production Method of Grease Composition" as mentioned later.

In the grease composition of one embodiment of the present invention, the content of the component (B) is preferably 1 to 40% by mass, more preferably 2 to 30% by mass, still more preferably 4 to 25% by mass, and yet still more preferably 6 to 20% by mass on a basis of the total amount (100% by mass) of the grease composition.

<Additive (C)>

The additive (C) which is contained in the grease composition of the present invention is composed of at least two selected from a sarcosine derivative (C1), an amine compound (C2), and an amide compound (C3).

Namely, an embodiment of the additive (C) is any one of the following (i) to (iv).

(i) An embodiment containing the component (C1) and the component (C2).
(ii) An embodiment containing the component (C1) and the component (C3).
(iii) An embodiment containing the component (C2) and the component (C3).
(iv) An embodiment containing the component (C1), the component (C2), and the component (C3).

The present inventors have found that a grease composition containing at least two selected from the components (C1) to (C3) can decrease the friction coefficient and improve the wear resistance, as compared with a grease composition containing one of the aforementioned components.

In particular, it has also been noted that in the case of being used for lubrication of a sliding portion constituted of a metal material and a resin material, the effect for improving the wear resistance of the resin material is large, and furthermore, in the case where a sliding speed is low, or in the case where a load applied to the sliding portion is relatively large, the effect for improving the wear resistance of the resin material is large.

At the same time, it has also been noted that by regulating the total content of the at least two selected from the components (C1) to (C3) to a specified range, the aforementioned effect is readily revealed.

Namely, the content of the additive (C) composed of at least two selected from the components (C1) to (C3) is required to be 0.1 to 10.0% by mass on a basis of the total amount (100% by mass) of the grease composition.

By regulating the content of the additive (C) to 10.0% by mass or less, there is brought such an advantage that the preparation of a grease composition with a high worked penetration becomes easy.

From the aforementioned viewpoint, in the grease composition of one embodiment of the present invention, the content of the component (C) is preferably 0.5 to 9.0% by mass, more preferably 1.0 to 8.5% by mass, still more preferably 1.4 to 8.0% by mass, and yet still more preferably 1.8 to 7.5% by mass on a basis of the total amount (100% by mass) of the grease composition.

In one embodiment of the present invention, for example, on the occasion of using for lubrication of the sliding portion constituted of a metal material and a resin material, from the viewpoint of providing a grease composition capable of more decreasing the friction coefficient and improving the wear resistance of the resin material, it is preferred to contain the sarcosine derivative (C1) and the amine compound (C2), an embodiment of which is the embodiment of the aforementioned (i); and it is more preferred to contain the sarcosine derivative (C1), the amine compound (C2), and the amide component (C3), an embodiment of which is the embodiment of the aforementioned (iv).

In the embodiments (i) and (iv), a content ratio [(C1)/(C2)] of the component (C1) to the component (C2) is preferably 0.2 to 5.0, more preferably 0.25 to 4.0, still more preferably 0.33 to 3.0, and yet still more preferably 0.5 to 2.0 in terms of a mass ratio.

In the embodiments (i), (ii), and (iv), a content proportion of the component (C1) in the component (C) is preferably 10 to 70% by mass, more preferably 15 to 65% by mass, and still more preferably 20 to 60% by mass on a basis of the total amount (100% by mass) of the component (C).

In the embodiments (i), (iii), and (iv), a content proportion of the component (C2) in the component (C) is preferably 10 to 70% by mass, more preferably 15 to 65% by mass, and still more preferably 20 to 60% by mass on a basis of the total amount (100% by mass) of the component (C).

In the embodiments (ii) and (iv), a content proportion of the component (C3) in the component (C) is preferably 5 to 50% by mass, more preferably 10 to 40% by mass, and still more preferably 15 to 35% by mass on a basis of the total amount (100% by mass) of the component (C).

[Sarcosine Derivative (C1)]

The sarcosine derivative (C1) which is used in the present invention is an α-amino acid in which a secondary or tertiary amino group having a methyl group is bound to a carbon atom having a carboxy group bound thereto and may be N-methylglycine or an aliphatic amino acid having an N-methylglycine structure.

Examples of the sarcosine derivative (C1) include N-oleylsarcosine, N-methyl-oleylsarcosine, N-methyl-stearylsarcosine, N-octyl-oleylsarcosine, N-lauryl-oleylsarcosine, and N-lauryl-stearylsarcosine.

These sarcosine derivatives (C1) may be used alone or may be used in combination of two or more thereof.

The sarcosine derivative (C1) which is used in one embodiment of the present invention is preferably a compound represented by the following general formula (c-1).

(c-1)

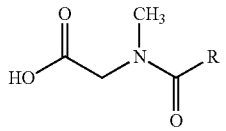

In the general formula (c-1), R is an alkyl group having 1 to 30 carbon atoms or an alkenyl group having 1 to 30 carbon atoms.

Although the carbon number of the alkyl group and the alkenyl group is 1 to 30, it is preferably 6 to 27, more preferably 10 to 24, and still more preferably 12 to 20.

The alkyl group may be a linear alkyl group or may be a branched alkyl group.

The alkenyl group may be a linear alkenyl group or may be a branched alkenyl group.

[Amine Compound (C2)]

The amine compound (C2) which is used in the present invention may be a compound having an amino group, and examples thereof include a monoamine, a diamine, and a triamine.

The amine compound (C2) may be used alone or may be used in combination of two or more thereof.

Of these, the amine compound (C2) which is used in one embodiment of the present invention is preferably a monoamine, and more preferably an aliphatic monoamine.

Examples of the aliphatic monoamine which is used in one embodiment of the present invention include a primary aliphatic monoamine represented by the following general formula (c2-i), a secondary aliphatic monoamine represented by the following general formula (c2-ii), and a tertiary aliphatic monoamine represented by the following general formula (c2-iii).

(c2-i)

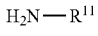

(c2-ii)

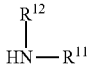

(c2-iii)

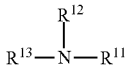

In the general formulae (c2-i) to (2c-iii), $R^{11}$ to $R^{13}$ are each independently an alkyl group or an alkenyl group, and preferably an alkenyl group.

The carbon number of the alkyl group and the alkenyl group which can be selected as $R^{11}$ to $R^{13}$ is preferably 8 to 22, more preferably 10 to 20, and still preferably 12 to 18.

The alkyl group may be a linear alkyl group or may be a branched alkyl group.

The alkenyl group may be a linear alkenyl group or may be a branched alkenyl group.

Examples of the primary aliphatic monoamine represented by the general formula (c2-i) include octylamine, laurylamine, stearylamine, and oleylamine.

Examples of the secondary aliphatic monoamine represented by the general formula (2c-ii) include dioctylamine, dilaurylamine, distearylamine, and dioleylamine.

Examples of the tertiary aliphatic monoamine represented by the general formula (2c-iii) include trioctylamine, trilaurylamine, tristearylamine, and trioleylamine.

The amine compound (C2) which is used in one embodiment of the present invention is preferably the primary aliphatic monoamine represented by the general formula (c2-i), and more preferably the primary aliphatic monoamine represented by the general formula (i) wherein $R^1$ is an alkenyl group having 8 to 22 carbon atoms.

[Amide Compound (C3)]

Although the amide compound (C3) which is used in the present invention may be a compound having an amide bond, it is preferably an acid amide resulting from a reaction between a carboxylic acid and an amine, and more preferably a fatty acid amide.

The amide compound (C3) may be used alone or may be used in combination of two or more thereof.

As the carboxylic acid, there is exemplified a linear or branched, saturated or unsaturated monocarboxylic acid. Specifically, examples thereof include a saturated fatty acid, such as heptanoic acid, octanoic acid, nonanoic acid, decanoic acid, undecanoic acid, dodecanoic acid, tridecanoic acid, tetradecanoic acid, pentadecanoic acid, hexadecanoic acid, heptadecanoic acid, octadecanoic acid, nonadecanoic acid, eicosanoic acid, heneicosanoic acid, docosanoic acid, tricosanoic acid, and tetracosanoic acid; and an unsaturated fatty acid, such as heptenoic acid, octenoic acid, nonenoic acid, decenoic acid, undecenoic acid, dodecenoic acid, tridecenoic acid, tetradecenoic acid, pentadecenoic acid, hexadecenoic acid, heptadecenoic acid, octadecenoic acid (inclusive of oleic acid), nonadecenoic acid, eicosenoic acid, heneicosenoic acid, docosenoic acid, tricosenoic acid, and tetracosenoic acid.

The saturated fatty acid and the unsaturated fatty acid each may be of a linear chain or a branched chain.

The position of the double bond which the unsaturated fatty acid has is arbitrary.

The carbon number of the carboxylic acid is preferably 7 to 30, more preferably 8 to 24, and still more preferably 10 to 22.

Examples of the amine include an alkylamine, an alkanolamine, and a polyalkylene polyamine.

Examples of the alkylamine include a primary aliphatic alkylamine, such as monomethylamine, monoethylamine, monopropylamine, monobutylamine, monopentylamine, monohexylamine, and monoheptylamine; and a secondary aliphatic alkylamine, such as dimethylamine, methylethylamine, diethylamine, methylpropylamine, ethylpropylamine, dipropylamine, methylbutylamine, ethylbutylamine, propylbutylamine, dibutylamine, dipentylamine, dihexylamine, and diheptylamine.

The alkyl group which the alkylamine has may be either linear or branched.

Examples of the alkanolamine include monomethanolamine, monoethanolamine, monopropanolamine, monobutanolamine, monopentanolamine, monohexanolamine, dimethanolamine, methanolethanolamine, diethanolamine, methanolprop anolamine, ethanolpropanolamine, dipropanolamine, methanolbutanolamine, ethanolbutanolamine, propanolbutanolamine, dibutanolamine, dipentanolamine, and dihexanolamine.

The alkanol group which the alkanolamine has may be either linear or branched.

Examples of the polyalkylenepolyamine include diethylenetriamine, triethylenetetramine, tetraethylenepentamine, pentaethylenehexamine, hexaethyleneheptamine, tetrapropylenepentamine, and hexabutyleneheptamine.

<Other Additive>

The grease composition of one embodiment of the present invention may contain other additive for grease than the component (C), which is blended with general greases, within a range where the effects of the present invention are not impaired.

Examples of such other additive for grease include an antioxidant, a rust inhibitor, an extreme pressure agent, a thickening agent, a solid lubricant, a detergent dispersant, a corrosion inhibitor, and a metal deactivator.

These additives for grease may be used alone or may be used in combination of two or more thereof.

Examples of the antioxidant include a phenol-based antioxidant.

Examples of the rust inhibitor include a carboxylic acid-based rust inhibitor, such as an alkenyl succinic acid polyhydric alcohol ester, zinc stearate, thiadiazole and a derivative thereof, and benzotriazole and a derivative thereof.

Examples of the extreme pressure agent include a zinc dialkyl dithiophosphate, a molybdenum dialkyl dithiophosphate, a thiocarbamic acid, such as an ashless dithiocarbamate, zinc dithiocarbamate, and molybdenum dithiocarbamate; a sulfur compound, such as sulfurized fats and oils, a sulfidized olefin, a polysulfide, a thiophosphoric acid, a thioterpene, and a dialkyl thiodipropionate; a phosphoric acid ester, such as tricresyl phosphate; and a phorphorous acid ester, such as triphenyl phosphite.

Examples of the thickening agent include a polymethacrylate (PMA), an olefin copolymer (OCP), a polyalkylstyrene (PAS), and a styrene-diene copolymer (SCP).

Examples of the solid lubricant include a polyimide, PTFE. graphite, a metal oxide, boron nitride, melamine cyanurate (MCA), and molybdenum disulfide.

Examples of the detergent dispersant include an ashless dispersant, such as succinimide and a boron-based succinimide.

Examples of the corrosion inhibitor include a benzotriazole-based compound and a thiazole-based compound.

Examples of the metal deactivator include a benzotriazole-based compound.

In the grease composition of one embodiment of the present invention, though the content of each of these additives for grease is appropriately set according to the kind of the additive, it is independently typically 0 to 10% by mass, preferably 0 to 7% by mass, more preferably 0 to 5% by mass, and still more preferably 0 to 2% by mass on a basis of the total amount (100% by mass) of the grease composition.

In the grease composition of one embodiment of the present invention, the total content of the additives including the component (C) is preferably 1 to 100 parts by mass, more preferably 3 to 80 parts by mass, still more preferably 5 to 60 parts by mass, and yet still more preferably 10 to 40 parts by mass based on 100 parts by mass of the total amount of the component (B).

[Production Method of Grease Composition]

As a method for producing the grease composition of the present invention, for example, there is exemplified a production method including the following steps (1) to (2).

Step (1): A step of blending a raw material of the thickener (B) with the base oil (A), to synthesize the thickener (B), thereby obtaining a grease base material.

Step (2): A step of blending the component (C) with the grease base material, to obtain a grease composition.

The additive for grease other than the component (C) may be added on the occasion of preparing the grease base material in the step (1) or may be added together with the component (C) in the step (2).

<Step (1)>

In the case where a metallic soap-based thickener is used as the thickener (B), a fatty acid serving as the raw material is added to and dissolved in the base oil (A), an equivalent amount of a metal hydroxide is further added, and then, the contents are heated while stirring, to allow the fatty acid and the metal hydroxide to react with each other, whereby the grease base material can be synthesized.

It is preferred that the metal hydroxide is added in a state of an aqueous solution thereof dissolved in water to the base oil (A) having the fatty acid dissolved therein. In addition, in the case where the metal hydroxide is added in a state of an aqueous solution thereof, in order to evaporate and remove the water in the solution, it is preferred to increase a temperature of the aqueous solution to 100° C. or higher.

A reaction temperature at which the fatty acid and the metal hydroxide react with each other is preferably 180 to 220° C., more preferably 185 to 210° C., and still more preferably 190 to 205° C.

After the reaction, by cooling the solution, the grease base material containing the metallic soap-based thickener is obtained.

Meanwhile, in the case where a urea-base thickener is used as the thickener (B), a solution β obtained by dissolving a monoamine in the base material (A) is added to a heated solution α obtained by dissolving an isocyanate compound in the base oil (A), to allow the isocyanate compound and the monoamine to react with each other, whereby the grease base material can be synthesized.

A method for preparing the grease composition in which the particle size distribution of particles containing the urea-based thickener satisfies the above requirements (I) and (II) is one as mentioned later.

<Step (2)>

The step (2) is a step of blending the component (C) with the grease base material obtained in the step (1), to obtain a grease composition.

A heating temperature of the grease base material in blending the component (C) is preferably 80 to 200° C., more preferably 90 to 180° C., still more preferably 100 to 160° C., and yet still more preferably 110 to 140° C. After blending, by thoroughly stirring the blend, the grease composition can be obtained.

It is preferred that the grease base material before blending the component (C), or the grease composition after blending the component (C) is cooled and then subjected to a milling treatment with a colloid mill, a roll mill, or the like.

<Preparation Method of Urea-based Thickener Satisfying Requirements (I) and (II)>

From the viewpoint of dispersing the urea-based thickener in the grease composition so as to satisfying the requirements (I) and (II), it is preferred to produce the urea-based thickener by using a grease manufacturing apparatus as expressed in the following [1].

[1] A grease manufacturing apparatus including a container body having an introduction portion into which a grease raw material is introduced and a discharge portion for discharging the grease into the outside; and a rotor having a rotation axis in an axial direction of the inner periphery of the container body and rotatably provided in the inside of the container body, the rotor including a first concave-convex portion in which (i) concave and convex are alternately provided along the surface of the rotor, the concave and convex being inclined to the rotation axis, and (ii) a feeding ability from the introduction portion to a direction of the discharge portion is provided.

While the grease manufacturing apparatus as set forth in the above [1] is hereunder described, the term "preferred" prescribed below is the embodiment from the viewpoint of dispersing the urea-based thickener in the grease composition so as to satisfy the requirements (I) and (II), unless otherwise specifically indicated.

FIG. 1 is a schematic cross-sectional view of the grease manufacturing apparatus as set forth in the above [1] that can be used in one embodiment of the present invention.

A grease manufacturing apparatus 1 shown in FIG. 1 includes a container body 2 for introducing a grease raw material into the inside thereof; and a rotor 3 having a rotation axis 12 on a central axis line of an inner periphery of the container body 2 and rotating around the rotation axis 12 as a center axis.

The rotor 3 rotates at high speed around the rotation axis 12 as a center axis to apply a high shearing force to a grease raw material inside the container body 2. Thus, the grease containing the urea-based thickener is produced.

As shown in FIG. 1, the container body 2 is preferably partitioned to an introduction portion 4, a retention portion 5, a first inner peripheral surface 6, a second inner peripheral surface 7, and a discharge portion 8 in this order from an upstream side.

As shown in FIG. 1, it is preferred that the container body 2 has an inner peripheral surface forming such a truncated cone shape that an inner diameter thereof gradually increases from the introduction portion 4 toward the discharge portion 8.

The introduction portion 4 serving as one end of the container body 2 is provided with a plurality of solution introducing pipes 4A and 4B for introducing a grease raw material from the outside of the container body 2.

The retention portion 5 is disposed in a downstream portion of the introduction portion 4, and is a space for temporarily retaining the grease raw material introduced from the introduction portion 4. When the grease raw material is retained in the retention portion 5 for a long time, grease adhered to the inner peripheral surface of the retention portion 5 forms a large lump, so that it is preferred to transport the grease raw material to the first inner peripheral surface 6 in the downstream side in a short time as far as possible. More preferably, it is preferred to transport the grease raw material directly to the first inner peripheral surface 6 without passing through the retention portion 5.

The first inner peripheral surface 6 is disposed in a downstream portion adjacent to the retention portion 5, and the second inner peripheral surface 7 is disposed in a downstream portion adjacent to the first inner peripheral surface 6. As mentioned later in detail, it is preferred to provide a first concave-convex portion 9 on the first inner peripheral surface 6 and to provide a second concave-convex portion 10 on the second inner peripheral surface 7, for the purpose of allowing the first inner peripheral surface 6 and the second inner peripheral surface 7 to function as a high shearing portion for imparting a high shearing force to the grease raw material or grease.

The discharge portion 8 serving as the other end of the container body 2 is a part for discharging the grease agitated on the first inner peripheral surface 6 and the second inner peripheral surface 7, and is provided with a discharge port 11 for discharging grease. The discharge port 11 is formed in a direction orthogonal or approximately orthogonal to the rotation axis 12. According to this, the grease is discharged from the discharge port 11 to the direction orthogonal or approximately orthogonal to the rotation axis 12. However, the discharge port 11 does not necessarily have to be made orthogonal to the rotation axis 12, and may be formed in a direction parallel or approximately parallel to the rotation axis 12.

The rotor 3 is rotatably provided on the center axis line of the inner peripheral surface of the container body 2, which has a truncated cone shape, as a rotation axis 12, and rotates counterclockwise when the container body 2 is viewed from the upstream portion to the downstream portion as shown in FIG. 1.

The rotor 3 has an outer peripheral surface that expands in accordance with the enlargement of the inner diameter of the truncated cone of the container body 2, and the outer peripheral surface of the rotor 3 and the inner peripheral surface of the truncated cone of the container body 2 are maintained at a constant interval.

On the outer peripheral surface of the rotor 3, a first concave-convex portion 13 of the rotor in which concave and convex are alternately provided along the surface of the rotor 3 is provided.

The first concave-convex portion 13 of the rotor is inclined to the rotation axis 12 of the rotor 3 in the direction of from the introduction portion 4 to the discharge portion 8, and has a feeding ability in the direction of from the introduction portion 4 to the discharge portion 8. That is, the first concave-convex portion 13 of the rotor is inclined in the direction in which the solution is pushed toward the downstream side when the rotor 3 rotates in the direction shown in FIG. 1.

A step difference between a concave portion 13A and a convex portion 13B of the first concave-convex portion 13 of the rotor is preferably 0.3 to 30, more preferably 0.5 to 15, and still more preferably 2 to 7, when the diameter of the concave portion 13A on the outer peripheral surface of the rotor 3 is 100.

The number of convex portions 13B of the first concave-convex portion 13 of the rotor in the circumferential direction is preferably 2 to 1,000, more preferably 6 to 500, and still more preferably 12 to 200.

A ratio of the width of the convex portion 13B to the width of the concave portion 13A of the first concave-convex portion 13 of the rotor [(width of the convex portion)/(width of the concave portion)] in the cross section orthogonal to the rotation axis 12 of the rotor 3 is preferably 0.01 to 100, more preferably 0.1 to 10, and still more preferably 0.5 to 2.

An inclination angle of the first concave-convex portion 13 of the rotor with respect to the rotation axis 12 is preferably 2 to 85°, more preferably 3 to 45°, and still more preferably 5 to 20°.

It is preferred that the first inner peripheral surface 6 of the container body 2 is provided with the first concave-convex portion 9 formed with a plurality of concave and convex along the inner peripheral surface thereof.

It is preferred that the concave and convex of the first concave-convex portion 9 on the side of the container body 2 are inclined in the opposite direction to the first concave-convex portion 13 of the rotor.

That is, it is preferred that the plurality of concave and convex of the first concave-convex portion 9 on the side of the container body 2 be inclined in the direction in which the solution is pushed toward the downstream side when the rotation axis 12 of the rotor 3 rotates in the direction shown in FIG. 1. The stirring ability and the discharge ability are further enhanced by the first concave-convex portion 9 having a plurality of concave and convex provided on the first inner peripheral surface 6 of the container body 2.

A depth of the concave and convex of the first concave-convex portion 9 on the side of the container body 2 is preferably 0.2 to 30, more preferably 0.5 to 15, and still more preferably 1 to 5, when the inner diameter (diameter) of the container is set to 100.

The number of concave and convex of the first concave-convex portion 9 on the side of the container body 2 is preferably 2 to 1,000, more preferably 6 to 500, and still more preferably 12 to 200.

A ratio of the width of the concave portion to the width of the convex portion between grooves in the concave and convex of the first concave-convex portion 9 on the side of the container body 2 [(width of the concave portion)/(width of the convex portion)] is preferably 0.01 to 100, more preferably 0.1 to 10, and still more preferably 0.5 to 2 or less.

An inclination angle of the concave and convex of the first concave-convex portion 9 on the side of the container body 2 to the rotation axis 12 is preferably 2 to 85°, more preferably 3 to 45°, and still more preferably 5 to 20°.

By providing the first concave-convex portion 9 on the first inner peripheral surface 6 of the container body 2, the first inner peripheral surface 6 can be made to function as a shearing portion for imparting a high shearing force to the grease raw material or grease, but the first concave-convex portion 9 does not necessarily have to be provided.

It is preferred that a second concave-convex portion 14 of a rotor having concave and convex alternately provided along the surface of the rotor 3 is provided on the outer peripheral surface of the downstream portion of the first concave-convex portion 13 of the rotor.

The second concave-convex portion 14 of the rotor is inclined to the rotation axis 12 of the rotor 3, and has a feeding suppression ability to push the solution back toward the upstream side from the introduction portion 4 toward the discharge portion 8.

A step difference of the second concave-convex portion 14 of the rotor is preferably 0.3 to 30, more preferably 0.5 to 15, and still more preferably 2 to 7, when the diameter of the concave portion of the outer peripheral surface of the rotor 3 is set to 100.

The number of convex portions of the second concave-convex portion 14 of the rotor in the circumferential direction is preferably 2 to 1,000, more preferably 6 to 500, and still more preferably 12 to 200.

A ratio of the width of the convex portion to the width of the concave portion of the second concave-convex portion 14 of the rotor in a cross section orthogonal to the rotation axis of the rotor 3 [(width of the convex portion)/(width of the concave portion)] is preferably 0.01 to 100, more preferably 0.1 to 10, and still more preferably 0.5 to 2.

An inclination angle of the second concave-convex portion 14 of the rotor to the rotation axis 12 is preferably 2 to 85°, more preferably 3 to 45°, and still more preferably 5 to 20°.

It is preferred that the second inner peripheral surface 7 of the container body 2 is provided with the second concave-convex portion 10 formed with a plurality of concave and convex adjacent to the downstream portion of the concave and convex in the first concave-convex portion 9 on the side of the container body 2.

It is preferred that the plurality of concave and convex are formed on the inner peripheral surface of the container body 2, and that the concave and convex are inclined in opposite directions to the inclination direction of the second concave-convex portion 14 of the rotor.

That is, it is preferred that the plurality of concave and convex of the second concave-convex portion 10 on the side of the container body 2 are inclined in the direction in which the solution is pushed back toward the upstream side when the rotation axis 12 of the rotor 3 rotates in the direction shown in FIG. 1. A stirring ability is more enhanced by the concave and convex of the second concave-convex portion 10 provided on the second inner peripheral surface 7 of the container body 2. In addition, the second inner peripheral surface 7 of the container body can function as a shearing portion which imparts a high shearing force to the grease raw material or grease.

A depth of the concave portion of the second concave-convex portion 10 on the side of the container body 2 is preferably 0.2 to 30, more preferably 0.5 to 15, and still more preferably 1 to 5, when the inner diameter (diameter) of the container body 2 is set to 100.

The number of concave portions of the second concave-convex portion 10 on the side of the container body 2 is preferably 2 to 1,000, more preferably 6 to 500, and still more preferably 12 to 200.

A ratio of the width of the convex portion of the concave and convex of the second concave-convex portion 10 on the side of the container body 2 to the width of the concave portion in the cross section orthogonal to the rotation axis 12 of the rotor 3 [(width of the convex portion)/(width of the concave portion)] is preferably 0.01 to 100, more preferably 0.1 to 10, and still more preferably 0.5 to 2 or less.

An inclination angle of the second concave-convex portion 10 on the side of the container body 2 to the rotation axis 12 is preferably 2 to 85°, more preferably 3 to 45°, and still more preferably 5 to 20°.

A ratio of the length of the first concave-convex portion 9 on the side of the container body 2 to the length of the second concave-convex portion 10 on the side of the container body 2 [(length of the first concave-convex portion)/(length of the second concave-convex portion)] is preferably 2/1 to 20/1.

Figure 2:
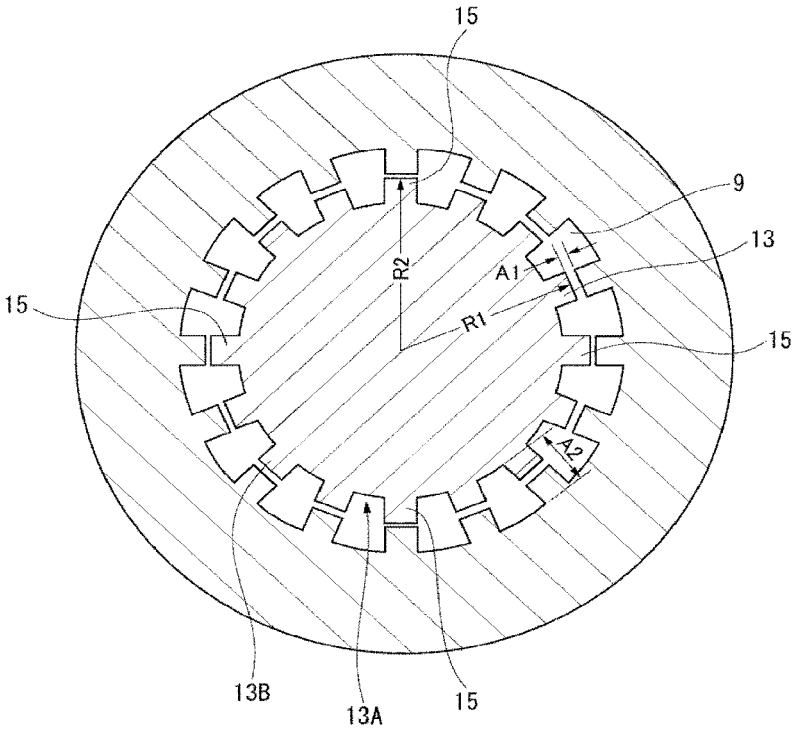
FIG. 2 is a schematic cross-sectional view of the direction orthogonal to a rotation axis in a first concave-convex portion on the side of a container body of the grease manufacturing apparatus of FIG. 1.

FIG. 2 is a cross-sectional view of the direction orthogonal to the rotation axis 12 in the first concave-convex portion 9 on the side of the container body 2 of the grease manufacturing apparatus 1.

In the first concave-convex portion 13 of the rotor shown in FIG. 2, a plurality of scrapers 15 each having a tip protruding toward the inner peripheral surface side of the container body 2 beyond the tip in the projecting direction of the convex portion 13B of the first concave-convex portion 13 are provided. In addition, though not shown, the second concave-convex portion 14 is also provided with a plurality of scrapers in which the tip of the convex portion protrudes toward the inner peripheral surface side of the container body 2, similarly to the first concave-convex portion 13.

The scraper 15 scrapes off the grease adhered to the inner peripheral surface of the first concave-convex portion 9 on the side of the container body 2 and the second concave-convex portion 10 on the side of the container body 2.

With respect to the protrusion amount of the tip of the scraper 15 relative to the projecting amount of the convex portion 13B of the first concave-convex portion 13 of the rotor, a ratio [R2/R1] of the radius (R2) of the tip of the scraper 15 to the radius (R1) of the tip of the convex portion 13B is preferably more than 1.005 and less than 2.0.

The number of scrapers 15 is preferably 2 to 500, more preferably 2 to 50, and still more preferably 2 to 10.

In the grease manufacturing apparatus 1 shown in FIG. 2, the scraper 15 is provided, but may not be provided, or may be provided intermittently.

In order to produce the grease containing the urea-based thickener by the grease manufacturing apparatus 1, the solution α and the solution β which are the aforementioned grease raw materials are introduced respectively from the solution introducing pipes 4A and 4B of the introduction portion 4 of the container body 2, and the rotor 3 is rotated at a high speed, whereby the grease base material containing the urea-based thickener can be produced.

Then, even by blending the additive containing the component (C) with the thus obtained grease base material, the urea-based thickener can be dispersed in the grease composition so as to satisfy the requirements (I) and (II).

As a high-speed rotation condition of the rotor 3, a shear rate applied to the grease raw material is preferably $10^2$ $s^{-1}$ or more, more preferably $10^3$ $s^{-1}$ or more, and still more preferably $10^4$ $s^{-1}$ or more, and it is typically $10^7$ $s^{-1}$ or less.

A ratio of a maximum shear rate (Max) to a minimum shear rate (Min) in the shearing at the time of high-speed rotation of the rotor 3 (Max/Min) is preferably 100 or less, more preferably 50 or less, and still more preferably 10 or less.

The shear rate to the mixed solution is as uniform as possible, thereby the dispersion of the thickener or a precursor thereof is improved, and a uniform grease structure is obtained.

Here, the maximum shear rate (Max) is a highest shear rate applied to the mixed solution, and the minimum shear rate (Min) is a lowest shear rate applied to the mixed solution, which are defined as follows.

Maximum shear rate (Max)=(linear velocity at the tip of the convex portion 13B of the first concave-convex portion 13 of the rotor)/(gap A1 between the tip of the convex portion 13B of the first concave-convex portion 13 of the rotor and the convex portion of the first concave-convex portion 9 of the first inner peripheral surface 6 of the container body 2)

Minimum shear rate (Min)=(linear velocity of the concave portion 13A of the first concave-convex portion 13 of the rotor)/(gap A2 between the concave portion 13A of the first concave-convex portion 13 of the rotor and the concave portion of the first concave-convex portion 9 on the first inner peripheral surface 6 of the container body 2)

The gap A1 and the gap A2 are as shown in FIG. 2.

The grease manufacturing apparatus 1 is provided with the scraper 15, thereby grease adhered to the inner peripheral surface of the container body 2 can be scraped off, so that the generation of the lumps during kneading can be prevented, and the grease in which the urea-based thickener is highly dispersed can be continuously produced in a short time.

In view of the fact that the scraper 15 scrapes off the grease adhered thereto, it is possible to prevent the retained grease from becoming a resistance to rotation of the rotor 3, so that the rotational torque of the rotor 3 can be reduced, and the power consumption of the drive source can be reduced, thereby making it possible to continuously produce the grease efficiently.

Since the inner peripheral surface of the container body 2 is in a shape of a truncated cone whose inner diameter increases from the introduction portion 4 toward the discharge portion 8, the centrifugal force has an effect for discharging the grease or grease raw material in the downstream direction, and the rotation torque of the rotor 3 can be reduced to continuously produce the grease.

Since the first concave-convex portion 13 of the rotor is provided on an outer peripheral surface of the rotor 3, the first concave-convex portion 13 of the rotor is inclined to the rotation axis 12 of the rotor 3, the first concave-convex portion 13 has a feeding ability from the introduction portion 4 to the discharge portion 8, the second concave-convex portion 14 of the rotor is inclined to the rotation axis 12 of the rotor 3, and the second concave-convex portion 14 has a feeding suppression ability from the introduction portion 4 to the discharge portion 8, a high shear force can be given to the solution, and the urea-based thickener can be dispersed in the grease composition so as to satisfy the requirements (I) and (II) even after blending the additive.

Since the first concave-convex portion 9 is formed on the first inner peripheral surface 6 of the container body 2 and is inclined in the opposite direction to the first concave-convex portion 13 of the rotor, in addition to the effect of the first concave-convex portion 13 of the rotor, sufficient stirring of grease raw material can be carried out while extruding the grease or grease raw material in the downstream direction, and the urea-based thickener can be dispersed in the grease composition so as to satisfy the requirements (I) and (II) even after blending the additive.

The second concave-convex portion 10 is provided on the second inner peripheral surface 7 of the container body 2, and the second concave-convex portion 14 of the rotor is provided on the outer peripheral surface of the rotor 3, thereby the grease raw material can be prevented from flowing out from the first inner peripheral surface 6 of the container body more than necessary, so that the urea-based thickener can be dispersed in the grease composition so as to satisfy the requirements (I) and (II) even after blending the additive by giving a high shear force to the solution to highly disperse the grease raw material.

[Physical Properties of Grease Composition of the Present Invention]

A worked penetration at 25° C. of the grease composition of one embodiment of the present invention is preferably 180 to 350, more preferably 200 to 330, still more preferably 220 to 310, and yet still more preferably 240 to 300.

In this specification, the worked penetration of the grease composition means a value measured at 25° C. in conformity with JIS K2220 7:2013.

A dropping point of the grease composition of one embodiment of the present invention is preferably 180° C. or higher, more preferably 220° C. or higher, still more preferably 240° C. or higher, and yet still more preferably 260° C. or higher.

In this specification, the dropping point of the grease composition means a value measured at 25° C. in conformity with JIS K2220 8:2013.

With respect to the grease composition of one embodiment of the present invention, an initial friction coefficient thereof as measured in conformity with an oscillating friction and wear test (SRV test) described in the section of Examples as mentioned later is preferably 0.18 or less, more preferably 0.16 or less, still more preferably 0.14 or less, and yet still more preferably 0.10 or less, and an average friction coefficient thereof is preferably 0.15 or less, more preferably 0.12 or less, still more preferably 0.10 or less, and yet still more preferably 0.08 or less.

[Application of Grease of the Present Invention]

The grease composition of the present invention has a high friction-reducing effect and excellent wear resistance to the member constituting the sliding portion, and in particular, when used for lubrication of the sliding portion constituted of a metal material and a resin material, it has excellent wear resistance of the resin material.

For that reason, though the grease composition of the present invention can be suitably used for a lubrication application of a sliding portion of an apparatus of every sort, in particular, it is preferred to be used for a lubrication application of an apparatus having a sliding portion constituted of a metal material and a resin material.

More specifically, it is especially preferred to be used for a hub unit, an electric power stirring, an electric motor for driving, an electric motor flywheel for driving, a ball joint, a wheel bearing, a spline portion, a constant-velocity joint, a clutch booster, a servomotor, a blade bearing, or a bearing portion of an electric generator.

Examples of the field of the apparatus for which the grease composition of the present invention can be suitably used include the automobile field, the office equipment field, the machine-tool field, the windmill field, and the field for construction or agricultural machine.

Examples of the lubricating portion in the apparatus in the automobile field, for which the grease composition of the present invention can be suitably used, include a bearing portion in an apparatus, such as a radiator motor fan, a fan coupling, an alternator, an idler pulley, a hub unit, a water pump, a power window, a wiper, an electric power stirring, an electric motor for driving, an electric motor flywheel for driving, a ball joint, a wheel bearing, a spline portion, and a constant-velocity joint; and a bearing portion, a gear portion, or a sliding portion in an apparatus, such as a door lock, a door hinge, and a clutch booster.

Examples of the lubricating portion in the apparatus in the office equipment field, for which the grease composition of the present invention can be suitably used, include a fixing roll in an apparatus, such as a printer, and a bearing and a gear portion in an apparatus, such as a polygon motor.

Examples of the lubricating portion in the apparatus in the machine-tool field, for which the grease composition of the present invention can be suitably used, include a bearing portion in a speed reducer of a spindle, a servomotor, a craft robot, or the like.

Examples of the lubricating portion in the apparatus in the windmill field, for which the grease composition of the present invention can be suitably used, include a bearing portion of a blade bearing, an electric generator or the like.

Examples of the lubricating portion in the apparatus in the field for construction or agricultural machine, for which the grease composition of the present invention can be suitably used include a bearing portion, a gear portion, and a sliding portion of a ball joint, a spline portion or the like.

The grease composition of the present invention is preferably used for a lubrication application of an apparatus having the sliding portion constituted of the metal material and the resin material. The metal material may be substituted with a material with high strength (for example, a ceramic material).

Although the resin material constituting the sliding portion may be either a natural resin or a synthetic material, it is preferably a general-purpose plastic as a synthetic material (e.g., polyethylene, polystyrene, polypropylene, and polyvinyl chloride) and an engineering plastic, and from the viewpoint of heat resistance and mechanical strength, it is more preferably an engineering plastic.

Examples of the engineering plastic include a synthetic resin, such as a polyamide resin, a polyacetal resin, a polycarbonate resin, a polysulfone resin, a polyphenylene sulfide resin, a polyamide-imide resin, a polyetheretherketone resin, a phenol resin, a polyester resin, and an epoxy resin. Of these, it is preferred to contain at least one selected from a polyamide resin and a polyoxymethylene resin.

The present invention is also able to provide an apparatus of the following [1] and a use method of the following [2].

[1] An apparatus including a sliding portion constituted of a metal material and a resin material, wherein a grease composition containing a base oil (A), a thickener (B), and an additive (C) composed of at least two selected from a sarcosine derivative (C1), an amine compound (C2), and an amide compound (C3), the content of the component (C) being 0.1 to 10.0% by mass on a basis of the total amount of the grease composition, is used for lubrication of the sliding portion.

[2] A method of use of a grease composition, the method including using a grease composition containing a base oil (A), a thickener (B), and an additive (C) composed of at least two selected from a sarcosine derivative (C1), an amine compound (C2), and an amide compound (C3), the content of the component (C) being 0.1 to 10.0% by mass on a basis of the total amount of the grease composition, for lubrication of a sliding portion constituted of a metal material and a resin material.

With respect to the grease composition to be used in the above [1] and [2], suitable embodiments of the respective components and suitable properties of the lubricating oil composition, and so on are those as mentioned above.

EXAMPLES

The present invention is hereunder described in more detail with reference to Examples, but it should be construed that the present invention is by no means limited by these Examples. The measurement methods of various physical properties values are as follows.

(1) Kinematic Viscosity at 40° C., Kinematic Viscosity at 100° C., and Viscosity Index The measurement and calculation were performed in conformity with JIS K2283:2003.

(2) Worked Penetration

The measurement was performed at 25° C. in conformity with JIS K2220 7:2013.

(3) Dropping Point

The measurement was performed in conformity with JIS K2220 8:2013.

(4) Particle Size Distribution of Urea-based Thickener

A urea grease obtained in Production Example 1 as mentioned later was defoamed in vacuum and then filled in a 1-mL syringe; 0.10 to 0.15 mL of the urea grease was extruded from the syringe; and the extruded urea grease was placed on a surface of a platy cell of a fixture for paste cell.

Then, another platy cell was superimposed on the urea grease, thereby obtaining a measuring cell having the urea grease sandwiched by two sheets of the cells.

Using a laser diffraction particle size distribution analyzer (trade name: LA-920, manufactured by Horiba, Ltd.), a particle size distribution curve. on a volume basis, of the particles containing the urea-based thickener in the urea grease of the measuring cell was obtained.

In this particle size distribution curve, a peak at which the frequency became maximum was specified, and a value of the particle size at the peak at which the frequency became maximum, prescribed in the requirement (I) and a half width of the peak prescribed in the requirement (II) were calculated.

Production Example 1

(Synthesis of Grease Base Material)

To 45.0 parts by mass of a poly-α-olefin (PAO) as a base oil (kinematic viscosity at 40° C.: 30 $mm^2/s$, kinematic viscosity at 100° C.; 7.8 $mm^2/s$, viscosity index: 137) which had been heated at 70° C., 3.9 parts by mass of diphenylmethane-4,4'-diisocyanate (MDI) was added to prepare a solution α.

In addition, to 45.0 parts by mass of a separately prepared poly-α-olefin (PAO) (kinematic viscosity at 40° C.: 30 $mm^2/s$, kinematic viscosity at 100° C.: 7.8 $mm^2/s$, viscosity index: 137) which had been heated at 70° C., 4.9 parts by mass of stearylamine and 1.2 parts by mass of cyclohexylamine were added to prepare a solution β.

A molar ratio of stearylamine to cyclohexylamine was 60/40.

Then, using the grease manufacturing apparatus 1 shown in FIG. 1, the solution α which had been heated at 60 to 80° C. was introduced at a flow rate of 100 to 200 L/h from the solution introducing pipe 4A into the container body 2, and the solution β which had been heated at 60 to 80° C. was simultaneously introduced at a flow rate of 100 to 200 L/h from the solution introducing pipe 4B into the container body 2, and the solution α and the solution β were unintermittently continuously introduced into the container body 2 in a state of rotating the rotor 3. The rotation number of the rotator 3 of the grease manufacturing apparatus 1 used was 7,000 to 9,000 rpm.

In addition, on this occasion, a maximum shear rate (Max) was 10,500 $s^{-1}$, and stirring was performed by setting a ratio of a maximum shear rate (Max) to a minimum shear rate (Min) [Max/Min] to 3.5.

There was thus prepared a grease base material having the content of the urea-based thickener of 10.0% by mass.

The urea-based thickener contained in the obtained grease base material is corresponding to a compound represented by the general formula (b1) wherein $R^1$ and $R^2$ are selected from a cyclohexyl group and a stearyl group (octadecyl group), and $R^3$ is a diphenylmethylene group.

In addition a value of $\{[(X+Y)/(X+Y+Z)]\times 100\}$ as prescribed in the requirement (a) is "100", and the X/Y ratio as prescribed in the requirement (b) is "60/40".

Figure 3:
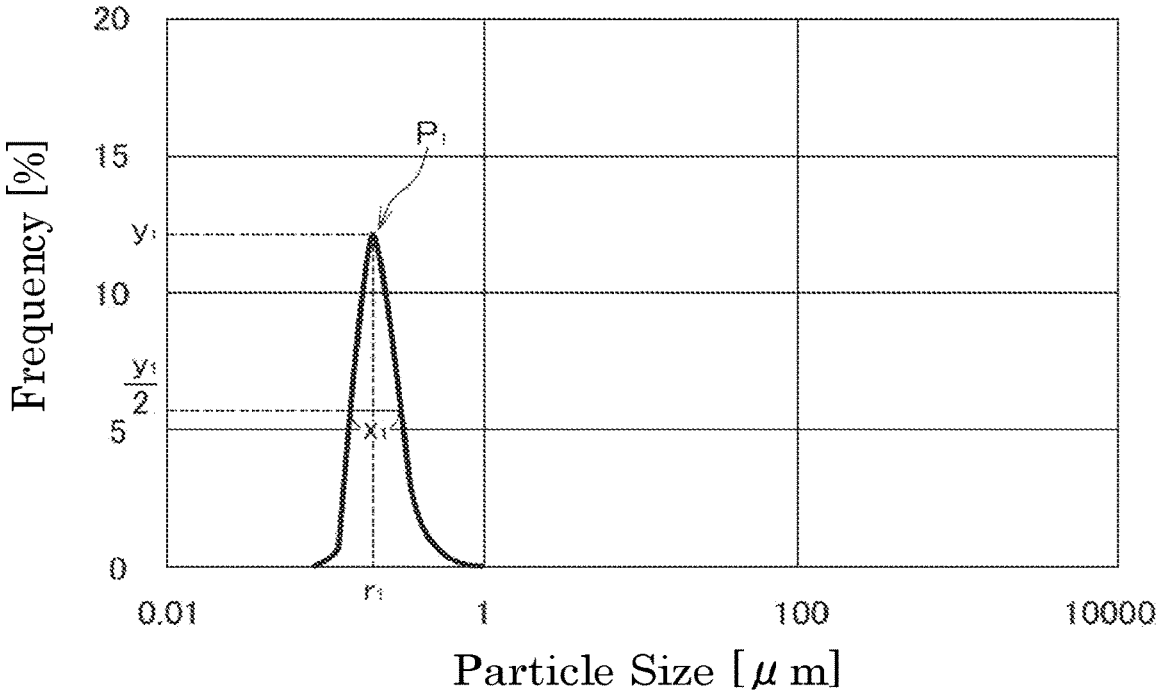
FIG. 3 is a particle size distribution curve of particles containing a urea-based thickener in a grease base material produced in Production Example 1 on a volume basis according to the light scattering particle size measurement.

Furthermore, upon acquiring the particle size distribution curve of the urea-based thickener on a basis of the aforementioned method, any peak at which the frequency became maximum was investigated. As a result, as shown in FIG. 3, a particle size $r_1$ at the peak $P_1$ at which the frequency $y_1$ became maximum was 0.6 μm, and a half width $x_1$ of the peak $P_1$ was 0.6 μm, and thus, the requirements (I) and (II) were satisfied.

Examples 1 to 11 and Comparative Example 1

The additives corresponding to the aforementioned components (C1) to (C3) were each added in the blending amount shown in Table 1 while stirring the grease base material obtained in Production Example 1 at 120° C., and the mixture was stirred for 0.5 hours and then allowed to be naturally cooled to 25° C., thereby preparing grease compositions, respectively.

The various additives used for the preparation of the grease compositions are as follows.

Component (C1): Oleylsarcosine (N-methyl-N-(1-oxo-9-octadecyl)glycine), which is a compound represented by the general formula (c-1) wherein R is an alkyl group having 17 carbon atoms (heptadecyl group).

Component (C2): Oleylamine (1-amino-9-octadecene), which is compound represented by the general formula (c2-i) wherein $R^{11}$ is an alkenyl group having 18 carbon atoms (9-octadeceyl group).

Component (C3): Fatty acid amide.

The prepared grease compositions were each subjected to the following SRV test, to measure an initial friction coefficient and an average friction coefficient. These results are shown in Tables 1 and 2.

[SRV Test]

On the occasion of using the prepared grease composition, the friction coefficient was measured with an SRV tester (manufactured by Optimol) under the following conditions. The friction coefficient after lapsing one minute after commencement of the test was designated as the "initial friction coefficient", and an average value of the friction coefficient for 11 minutes from commencement to completion of the test was designated as the "average friction coefficient".

Cylinder: PA66 (polyamide 66)

Disk: SUJ-2 material (steel material)

Vibration number: 1 Hz

Amplitude: 1.0 mm

Load: 200 N

Temperature: 25° C.

Test time: 11 minutes

TABLE 1

| | | | | Example 1 | Example 2 | Example 3 | Example 4 | Example 5 | Example 6 | Example 7 |
|---|---|---|---|---|---|---|---|---|---|---|
| Composition of grease composition | Component (A) | PAO | mass % | 84.6 | 88.2 | 84.6 | 84.6 | 84.6 | 87.3 | 88.6 |
| | Component (B) | Urea-based thickener | mass % | 9.4 | 9.8 | 9.4 | 9.4 | 9.4 | 9.7 | 9.9 |
| | Component (C1) | Oleylsacosine | mass % | 3.0 | 1.0 | — | 3.0 | 2.0 | 1.0 | 0.5 |
| | Component (C2) | Oleylamine | mass % | 3.0 | 1.0 | 3.0 | — | 2.0 | 1.0 | 0.5 |
| | Component (C3) | Fatty acid amide | mass % | — | — | 3.0 | 3.0 | 2.0 | 1.0 | 0.5 |
| | Total | | mass % | 100.0 | 100.0 | 100.0 | 100.0 | 100.0 | 100.0 | 100.0 |
| Content of component (C) in grease composition | | | mass % | 6.0 | 2.0 | 6.0 | 6.0 | 6.0 | 3.0 | 1.5 |
| Content proportion of component (C3) in component (C) | | | mass % | — | — | 50.0 | 50.0 | 33.3 | 33.3 | 33.3 |
| Component (C1)/Component (C2) (mass ratio) | | | — | 1.0 | 1.0 | — | — | 1.0 | 1.0 | 1.0 |
| Evaluation | Worked penetration | | — | 280 | 283 | 280 | 294 | 288 | 283 | 289 |
| | Dropping point | | ° C. | 260< | 260< | 260< | 260< | 260< | 260< | 260< |
| | Initial friction coefficient | | — | 0.13 | 0.10 | 0.16 | 0.16 | 0.10 | 0.09 | 0.14 |
| | Average friction coefficient | | — | 0.10 | 0.07 | 0.12 | 0.12 | 0.06 | 0.06 | 0.12 |

| | | | | Example 8 | Example 9 | Example 10 | Example 11 | Comparative Example 1 |
|---|---|---|---|---|---|---|---|---|
| Composition of grease composition | Component (A) | PAO | mass % | 87.7 | 85.5 | 85.5 | 85.5 | 90.0 |
| | Component (B) | Urea-based thickener | mass % | 9.8 | 9.5 | 9.5 | 9.5 | 10.0 |
| | Component (C1) | Oleylsacosine | mass % | 1.0 | 3.0 | 1.0 | 1.0 | — |
| | Component (C2) | Oleylamine | mass % | 1.0 | 1.0 | 3.0 | 1.0 | — |
| | Component (C3) | Fatty acid amide | mass % | 0.5 | 1.0 | 1.0 | 3.0 | — |
| | Total | | mass % | 100.0 | 100.0 | 100.0 | 100.0 | 100.0 |
| Content of component (C) in grease composition | | | mass % | 2.5 | 5.0 | 5.0 | 5.0 | 0.0 |
| Content proportion of component (C3) in component (C) | | | mass % | 20.0 | 20.0 | 20.0 | 60.0 | — |
| Component (C1)/Component (C2) (mass ratio) | | | — | 1.0 | 3.0 | 0.3 | 1.0 | — |
| Evaluation | Worked penetration | | — | 284 | 285 | 286 | 284 | 275 |
| | Dropping point | | ° C. | 260< | 260< | 260< | 260< | 260< |
| | Initial friction coefficient | | — | 0.13 | 0.10 | 0.11 | 0.10 | 0.28 |
| | Average friction coefficient | | — | 0.11 | 0.07 | 0.08 | 0.08 | 0.21 |

The grease compositions of Examples 1 to 11 are low in the friction coefficient as compared with that of Comparative Example 1, and it may be said that they are excellent especially in the wear resistance to the resin material.

REFERENCE SIGNS LIST

1: Grease manufacturing apparatus
2: Container body
3: Rotor
4: Introduction portion
4A, 4B: Solution introducing pipe
5: Retention portion
6: First inner peripheral surface of container body
7: Second inner peripheral surface of container body
8: Discharge portion
9: First concave-convex portion on the side of container body
10: Second concave-convex portion on the side of container body
11: Discharge port
12: Rotation axis
13: First concave-convex portion of rotor
13A: Concave portion
13B: Convex portion
14: Second concave-convex portion
15: Scraper
A1, A2: Gap

The invention claimed is:

1. A grease composition, comprising a base oil (A), a thickener (B), and an additive (C) comprising a sarcosine derivative (C1), an amine compound (C2), and an amide compound (C3), wherein the base oil (A) is a synthetic oil, and a content of the base oil (A) is from 50% by mass to 98.9% by mass, based on a total amount 100% by mass of the grease composition, wherein a content of the thickener (B) is from 1% by mass to 40% by mass, based on the total amount 100% by mass of the grease composition, wherein the sarcosine derivative (C1) is a compound represented by the following general formula (c-1):

(c-1)

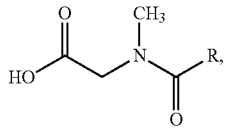

wherein R is an alkyl group having 1 to 30 carbon atoms or an alkenvl group having 1 to 30 carbon atoms, wherein the amine compound (C2) is a compound represented by a primary aliphatic monoamine represented by the following formula (c2-i), a secondary aliphatic monoamine represented by the following formula (c2-ii), a tertiary aliphatic monoamine represented by the following general formula (c2-iii), or a combination thereof:

(c2-i)

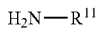

(c2-ii)

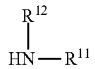

(c2-iii)

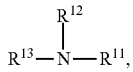

wherein $R^{11}$ to $R^{13}$ are each independently an alkyl group or an alkenyl group, wherein the amide compound (C3) is an acid amide resulting from a reaction between a carboxylic acid and an amine, wherein the amount of the additive (C) is from 0.1 to 10.0% by mass based on a total amount of the grease composition, wherein:

the thickener (B) is a urea-based thickener, and in a particle size distribution curve of particles comprising the urea-based thickener on a volume basis according to a light scattering particle size measurement, a peak at which a frequency becomes maximum satisfies the following requirements (I) and (II):

(I) a particle size at the peak is 1.0 μm or less, and (II) a half width of the peak is 1.0 μm or less.

2. The grease composition of claim 1, wherein a content of the amide compound (C3) is from 5 to 50% by mass, based on the total amount of the additive (C).

3. The grease composition of claim 1, wherein a content ratio [(C1)/(C2)] of the sarcosine derivative (C1) to the amine compound (C2) is from 0.2 to 5.0.

4. The grease composition of claim 1, wherein the amine compound (C2) is the primary aliphatic monoamine.

5. A method comprising:

applying the grease composition of claim 1 to a sliding portion comprising a metal material and a resin material, for lubrication.

6. The grease composition of claim 1, wherein the formulas (c2-i) to (2c-iii), $R^{11}$ to $R^{13}$ are each independently an alkenyl group.

7. The grease composition of claim 1, wherein the amine compound (C2) is the secondary aliphatic monoamine.

8. The grease composition of claim 1, wherein the amine compound (C2) is the tertiary aliphatic monoamine.

* * * * *